US007623082B2

(12) United States Patent
Meschini

(10) Patent No.: US 7,623,082 B2
(45) Date of Patent: Nov. 24, 2009

(54) ACTUATION MECHANISM WITH THREE-DIMENSIONAL RECTILINEAR GUIDE

(75) Inventor: Alberto Meschini, Rome (IT)

(73) Assignee: Finmeccanica S.p.A., Rome (IT)

( * ) Notice: Subject to any disclaimer, the term of this patent is extended or adjusted under 35 U.S.C. 154(b) by 0 days.

(21) Appl. No.: 11/993,933

(22) PCT Filed: Jun. 26, 2006

(86) PCT No.: PCT/IT2006/000490

§ 371 (c)(1),
(2), (4) Date: Jun. 3, 2008

(87) PCT Pub. No.: WO2007/000789

PCT Pub. Date: Jan. 4, 2007

(65) Prior Publication Data

US 2008/0258987 A1 Oct. 23, 2008

(30) Foreign Application Priority Data

Jun. 28, 2005 (IT) ..... RM2005A0337

(51) Int. Cl.
*H01Q 3/10* (2006.01)

(52) U.S. Cl. ..... 343/761; 343/763; 343/758; 343/757

(58) Field of Classification Search ..... None
See application file for complete search history.

(56) References Cited

U.S. PATENT DOCUMENTS

| | | | | |
|---|---|---|---|---|
| 5,485,168 | A * | 1/1996 | Parekh | 343/761 |
| 6,229,501 | B1 * | 5/2001 | Roth et al. | 343/915 |
| 6,466,179 | B1 * | 10/2002 | Ehrenberg et al. | 343/840 |
| 7,411,561 | B1 * | 8/2008 | Baldauf et al. | 343/781 P |
| 2003/0112194 | A1 * | 6/2003 | Watson | 343/757 |

FOREIGN PATENT DOCUMENTS

EP 0 336 745 A 10/1989

* cited by examiner

*Primary Examiner*—Trinh V Dinh
(74) *Attorney, Agent, or Firm*—Ladas & Parry LLP

(57) ABSTRACT

An actuation system which implements a three-dimensional rectilinear guide with high rectilinear features and it provides stability and stiffness to the moved object by supporting it in a not operating initial phase, particularly suitable to the translation of reflectors for satellite antennas along a predetermined axis in order to obtain the zooming effect thereof on the radiation diagram of the antenna itself.

6 Claims, 11 Drawing Sheets

ACTUATION MECHANISM WITH THREE-DIMENSIONAL RECTILINEAR GUIDE

This application is a 371 PCT/IT2006/000490 filed on Jun. 26, 2006 which is incorporated herein by reference in its entirety.

The invention relates to an actuation mechanism with three-dimensional rectilinear guide (named ZAM) particularly suitable, but not limited, to the translation of reflectors for satellite antenna along a predetermined axis in order to obtain a zooming effect on the radiation diagram of the antenna itself.

The invention consists of a mechanical system able to implement the linear motion of an object and at the same time to guide it with a high degree of rectilinearity in the space along a predetermined trajectory having a length significantly greater than the sizes of the system itself.

Furthermore, the system is able to support the object to be moved, during a phase called transportation phase, with stiffness and resistance which can be sized according to needs. In the subsequent operating phase the system is able to position the object in any point of the rectilinear trajectory with high stiffness and precision in the six degrees of freedom of the interface flange which can be determined based upon the physical and geometrical features of the system.

The invention, then, is suitable, but not limited, to implement the translation of a reflector in an antenna with, for example, Gregorian optics according to a determined direction and for a quantity in the order of 20-40% of the sizes of the reflector itself by obtaining the so-called 'Zooming' function according to what described in the U.S. Pat. No. 5,977,923.

STATE OF ART

Exact rectilinear guides in the three-dimensional space can be implemented in different ways:

1. By means of heavy mechanical components such as simple slides or slides with ball-recirculation and moved by a linear or rack actuator.
2. By means of very bulky and substantially bi-dimensional mechanisms with long inflexion, such as the Watt parallelogram.
3. By means of multilink systems, constituted by a number of constraints so as to lock 5 of the 6 degrees of freedom of a stiff body, by guaranteeing it an approximate rectilinear path.
4. By means of the Peaucellier mechanism or reverser which is an exact rectilinear, but substantially a bi-dimensional guide.
5. By means of the Sarrus mechanism which is an exact rectilinear three-dimensional guide.

ADVANTAGES OF THE INVENTION

The innovative aspect of the instant invention is underlined hereinafter by making reference to the Sarrus guide.

The Sarrus rectilinear guide is based upon the use of rotoidal pairs with one degree of freedom (ball bearings, to exemplify) and it is the only one mentioned in all robotics publications able to implement an exact three-dimensional rectilinear motion.

The advantage of the mechanism of the instant invention, based upon the use of only rotoidal pairs as well, with respect to the Sarrus guide lies in the size of the mechanism itself, being shifts equal.

Sizes are determining factors for the spatial environments, especially in an application wherein the mechanism must be let down inside the optics of an antenna (for example, a Gregorian antenna) imposing many constraints, as it has to be put on a satellite.

Smaller sizes also mean low weight, but also high stiffness of the parts composing the mechanism.

In order to state the difference between the two mechanisms in quantitative terms, the ZAM shift, with respect to a Sarrus mechanism having the same envelope, is double at least. This mechanism compactness allows the integration thereof inside an antenna (for example, a Gregorian antenna), and in particular below the main reflector, without substantially modifying the mechanical design (as shown in FIGS. 22 and 23).

The ZAM design also provides the implementation of the motorization system, constituted by a linear actuator and by a lock system during the launch phase.

Another ZAM relevant feature is the kinematics' isostaticity and the way as this is connected to the linear actuation system, the feature being mainly linked to the triangular structure of the kinematism which allows a sequential settlement of the dimensional tolerances between the three types of mechanism and cascade-connected there between. A comparison to the Sarrus guide is not possible since such application makes use of rotative actuators.

The locking system is useful to not overload mechanical leverages of the mechanism itself and provide a very high stiffness of the flange supporting the part to be moved, i.e. the reflector.

DESCRIPTION OF THE INVENTION

It is an object of the invention an actuation system which implements a three-dimensional rectilinear guide with high rectilinear features and it provides stability and stiffness to the moved object by supporting it in a not operating initial phase, particularly suitable, but not limited, to the translation of reflectors for satellite antennas along a predetermined axis in order to obtain the zooming effect thereof on the radiation diagram of the antenna itself.

The actuation mechanism is characterized by a kinematic system constituted by a cascade system of three different TYPES (1 to 3) of kinematisms operating on three planes arranged at 120 degrees therebetween and actuated by a linear actuator placed along the symmetry axis of the kinematism itself.

Preferably the kinematism of TYPE 1 of FIG. 17 is constituted by the Links 1, 2, 3 and 4 of FIG. 19 and appears equal in three planes $\pi$1 belonging to the beam having the axis $z_0$ as support and rotated by 120° therebetween. The Links 3 and 4 of FIG. 16 are constrained in fixed mutual position and hinged together in a fixed point in the space.

Preferably the kinematism of TYPE 2 of FIG. 18 is constituted by three pairs of Links 5 which lie in three planes $\pi_2$ rotated by 30° with respect to the respective $\pi_1$. Such planes form the side faces of a prism with equilateral triangular base the lower vertices thereof are the ends of the three Links 4 of FIG. 13, constrained to the Links 5 by means of a suitable articulated joint. Such articulated joint, shown in FIG. 19, allows to each Link 4 to actuate a pair of Links 5 belonging to two different spiders. The kinematic property of the articulated joints lies in the fact of being connected to the Links 4 by means of a ball joint and to the Links 5 by means of cylindrical joints, the axes thereof, orthogonal to the respective belonging planes of the Links, intersect in the centre of the ball joint, by preventing the formation of not balanced pairs. An equal three-dimensional articulated joint is fastened to the upper ends of the Links 5 where the Links 6 converge.

Preferably the kinematism of TYPE 3 of FIG. 20 is a mechanical leverage which transmit the motion to the upper platform and the contemporary action of the three Links 6 in the respective planes $\pi_1$ obliges the platform to translate along the axis $z_0$.

In a particular embodiment the actuation is implemented by means of a linear actuator of electromechanical type, preferably constituted by a motor, an operating screw and a nut screw.

In a particular alternative embodiment the actuation is implemented by means of a linear actuator of hydraulic or pneumatic type.

The mechanism of the invention is able to support the object to be moved, during a phase called transport phase, which stiffness and resistance which can be sized according to the needs by means of a retention system equipped with a device with controlled release.

In a particular embodiment the retention and release system is implemented by means of three V-like structure placed at 120 degrees connected to the supporting structure by means of elastic hinges.

In a particular alternative embodiment the retention and release system is implemented by means of three V-like structures placed at 120 degrees connected to the supporting structure by means of conventional hinges based upon the use of bearings or bushes.

In a particular embodiment the controlled release is obtained by means of a device with shape-memory alloys.

In a particular alternative embodiment the controlled release is obtained by means of a pyrotechnical device.

The invention is now described by way of illustration and not for limitative purposes, by making reference to the enclosed figures. It is specified that the invention is described by referring to an optics of Gregorian type, but nothing prevents it from being used in any reflector antenna of different type or in any application wherein the linear motion of an object along a rectilinear trajectory is required.

Figure 1:
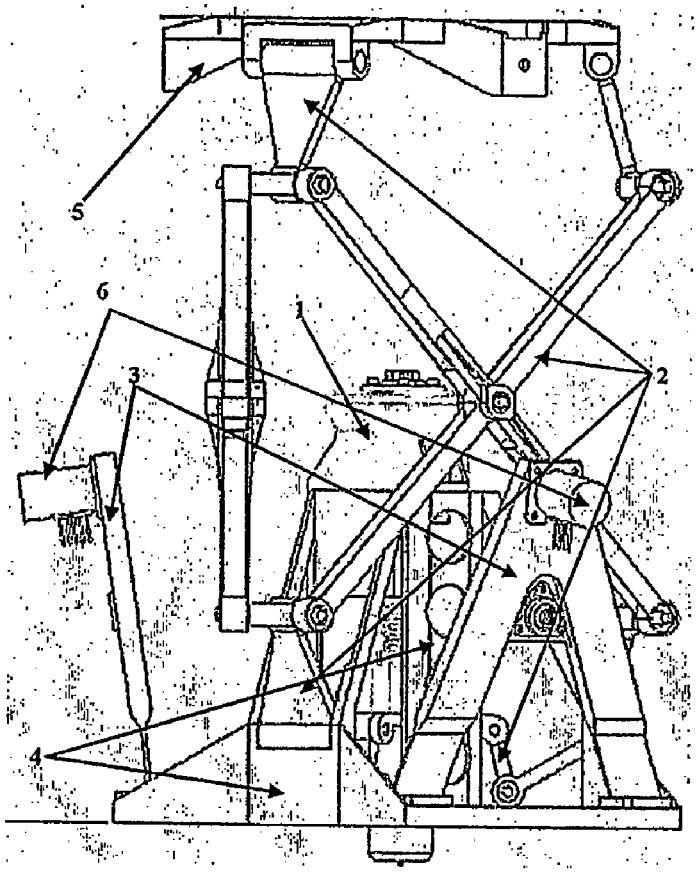
FIG. 1 shows a lateral view of the mechanism in its operating configuration.

According to FIG. 1, the mechanism in its operating configuration is constituted by a linear actuator (1), a system of multiple mechanical leverages or kinematisms (2), a retention and release system (3), a supporting structure (4), an interface flange for the object to be moved (5), a device with controlled release (6).

Figure 2:
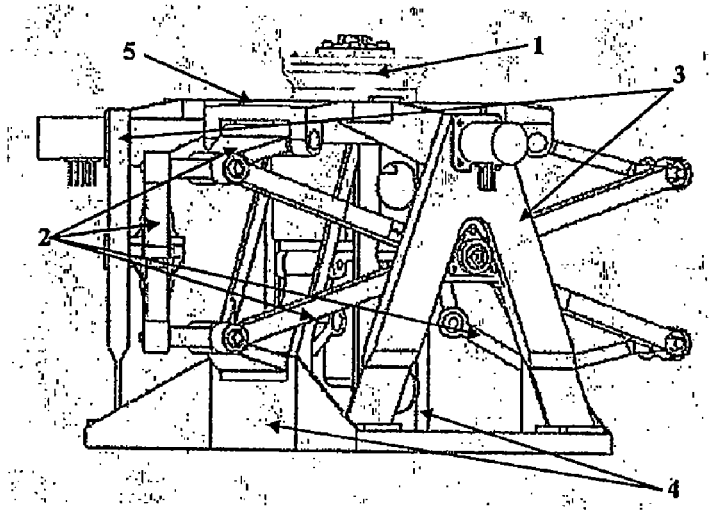
FIG. 2 shows a lateral view of the mechanism in its not operating configuration.

According to FIG. 2, the mechanism in its not operating configuration shows the retention and release system (3) in closed condition, whereas the multiple mechanical leverages (2) appear retracted.

Figure 5:
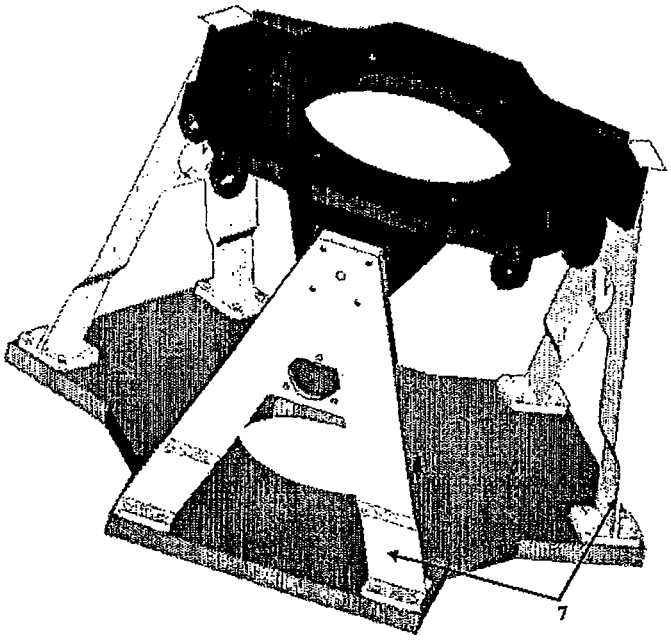
FIG. 5 shows a prospect view of the retention and release system.

The retention and release system (3) is shown in FIG. 5. It is mainly constituted by three upside-down V-like structures which connect at the top with the interface flange (5) by means of a device with controlled release (6) and arranged on three planes at 120 degrees therebetween. The V-like structures are connected to the supporting structure (4) by means of hinges or elastic joints (7) which allow the moving away thereof from the interface flange (4) after the device with controlled release (6) has been activated.

Figure 3:
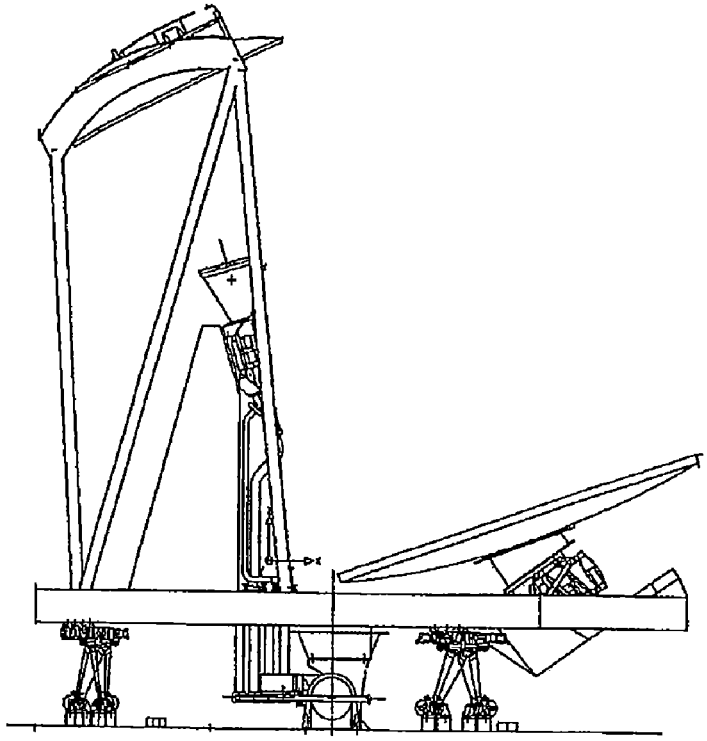
FIG. 3 shows a lateral view of the mechanism inserted in an optical system of reflector antenna.

The mechanism when inserted into an optical system of reflector antenna allows implementing the translation of a reflecting surface as shown FIG. 3, in the case of a reflector antenna of the "Dual Gregorian" type in not operating configuration, namely with the retention and release system (3) in closed condition and with retracted multiple mechanical leverages (2).

Figure 4:
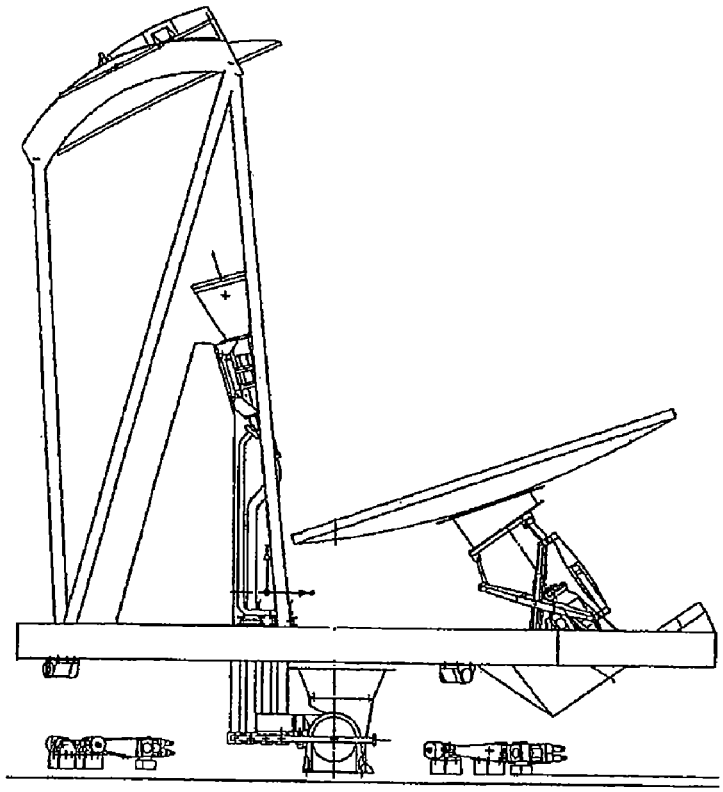
FIG. 4 shows a lateral view of the antenna itself.

The same antenna is shown in FIG. 4 in operating condition with the retention and release system (3) in opened condition and with the multiple mechanical leverages (2) extended in the position thereof of maximum elongation.

Figure 6:
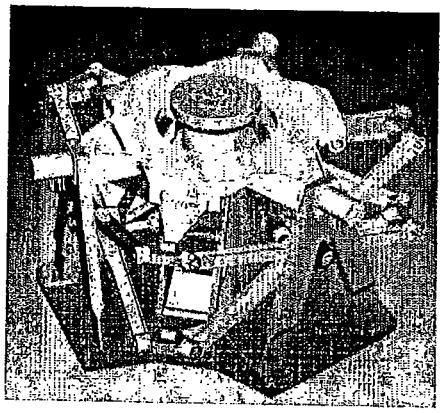
FIG. 6 shows prospect view of a structural and functional configuration of the mechanism of the invention in not operating condition with the retention and release system as closed.

A structural and functional configuration of the ZAM mechanism in not operating condition with the closed retention and release system is shown in FIG. 6.

Figure 7:
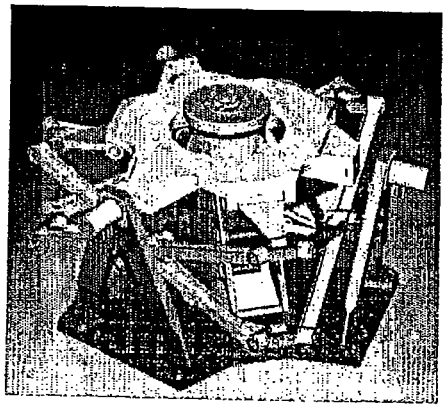
FIG. 7 shows a prospect view of a structural and functional configuration of the mechanism of the invention in not operating condition, but with the retention and release system as opened.

A structural and functional configuration of the ZAM mechanism in not operating condition, but with the opened retention and release system is shown in FIG. 7.

Figure 8:
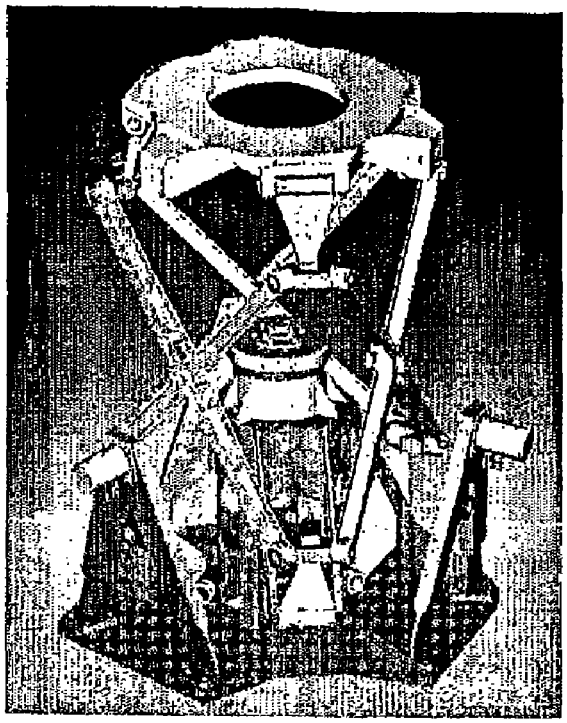
FIG. 8 shows a prospect view of a structural and functional configuration of the mechanism of the invention in operating condition with the opened retention and release system and the system of multiple mechanical leverages.

A structural and functional configuration of the ZAM mechanism in operating condition and therefore with the opened retention and release system and the system of multiple mechanical leverages is shown in FIG. 8.

Once the ZAM is in operating condition, substantially three operating modes of the antenna can be identified, which do not coincide with the ones of the mechanism, with no limits for intermediate positions which are omitted by way of simplicity.

Figure 9:
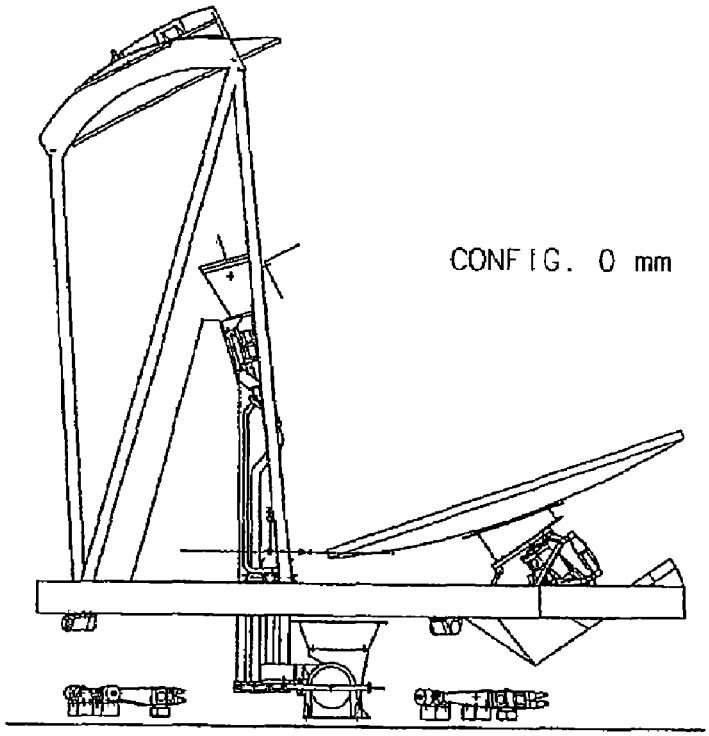
FIG. 9 shows a lateral view of the reflector in nominal position, with a covering extension of nominal sizes.

The reflector in nominal position, namely with a covering extension of nominal sizes, is shown in FIG. 9.

Figure 10:
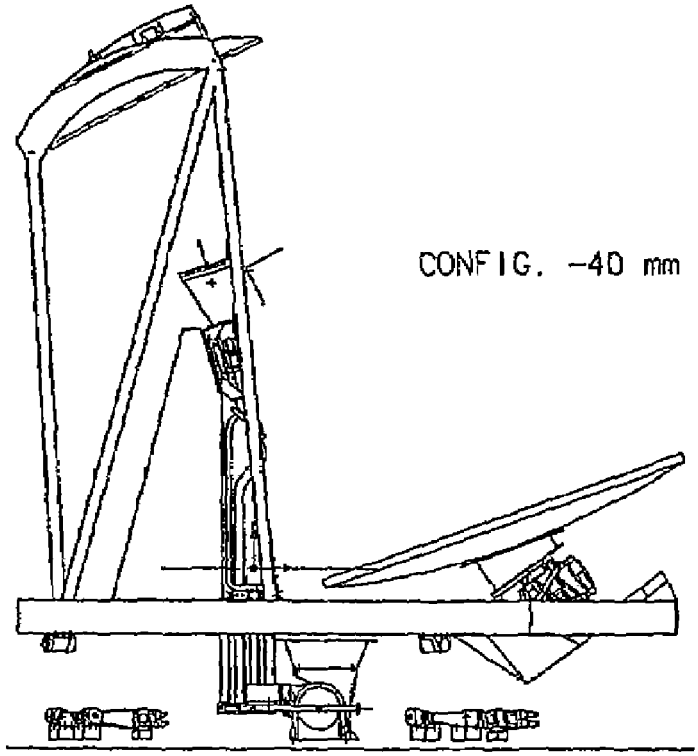
FIG. 10 shows a lateral view of the reflector in backed position, with a covering extension of minimal sizes.

The reflector in backed position, namely with a covering extension of minimal sizes, is shown FIG. 10.

Figure 11:
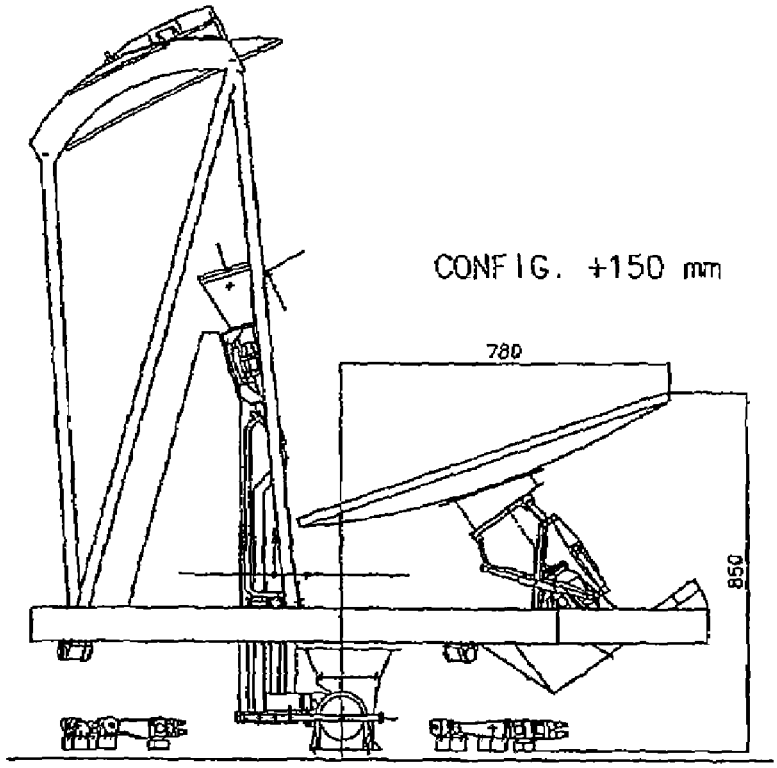
FIG. 11 shows a lateral view of the reflector in advanced position, with a covering extension of maximum sizes.

The reflector in advanced position, namely with a covering extension of maximum sizes, is shown in FIG. 11.

Kinematics of the Invention

Figure 12:
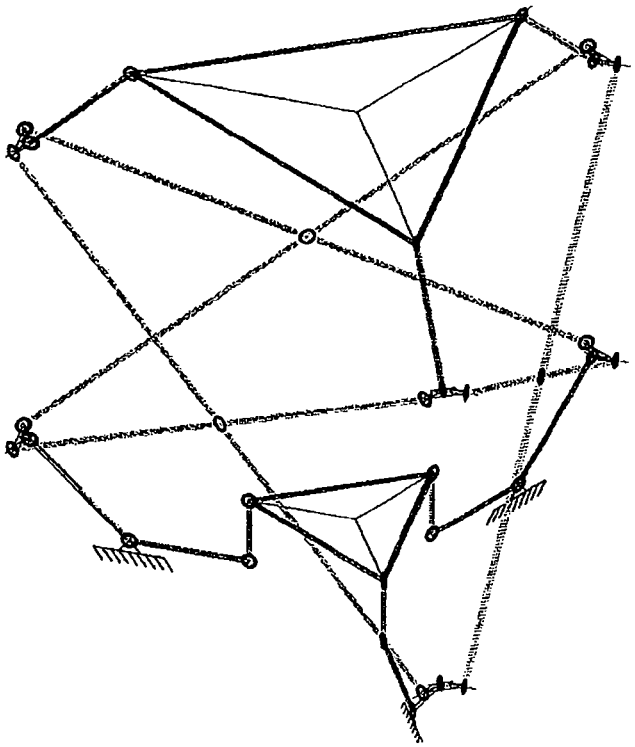
FIG. 12 shows a scheme of the mechanism of the invention constituted by three terns of plane kinematisms which connect therebetween two triangular equilateral platforms, parallel therebetween.
Figure 13:
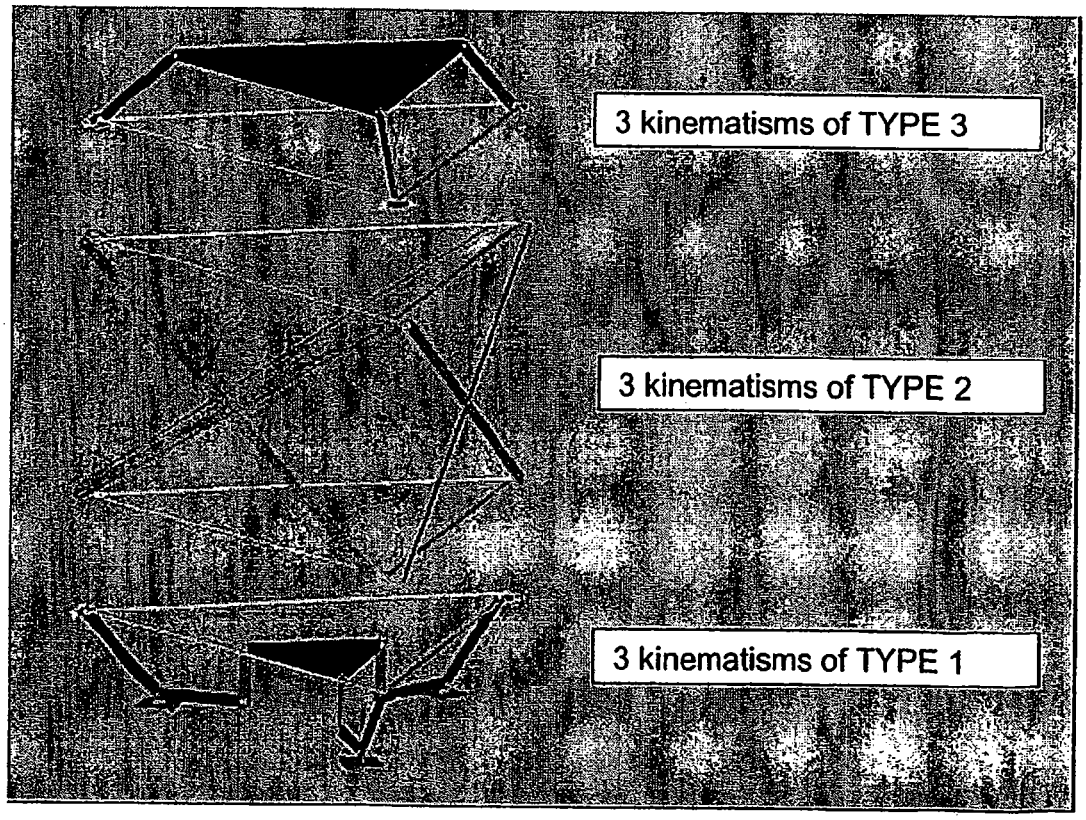
FIG. 13 shows a prospect view of the scheme of the three terns of plane kinematisms.

The ZAM is constituted by three terns of plane kinematisms which connect two triangular equilateral parallel platforms one to the other, as shown in FIG. 12 and in FIG. 13. A single tern is represented in FIG. 14 and FIG. 15 and it is constituted by a kinematism of TYPE 1, one of TYPE 2 and one of TYPE 3.

Figure 14:
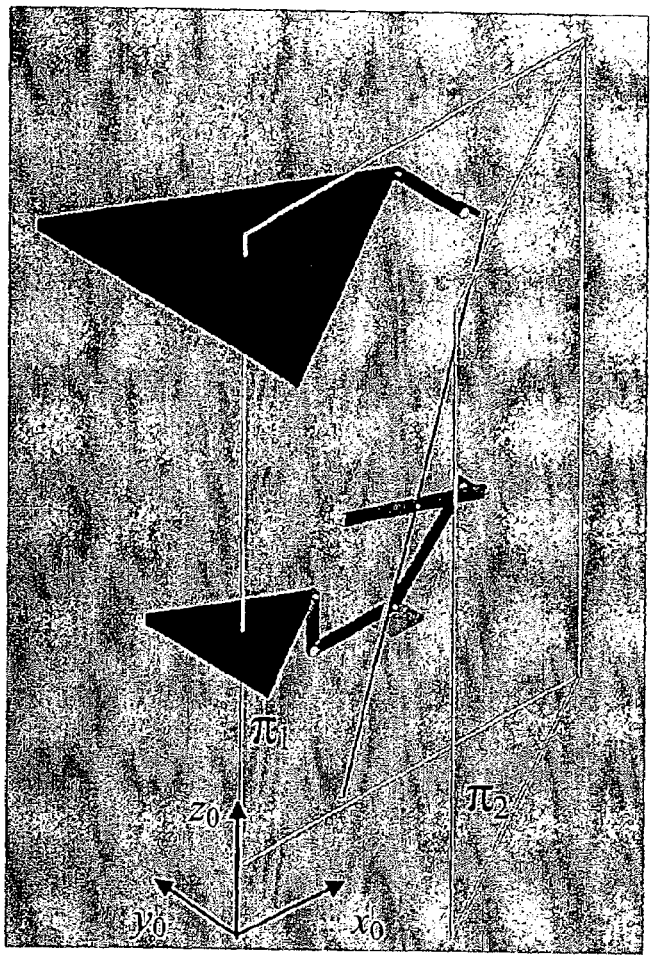
FIG. 14 shows a prospect view of a single tern.
Figure 15:
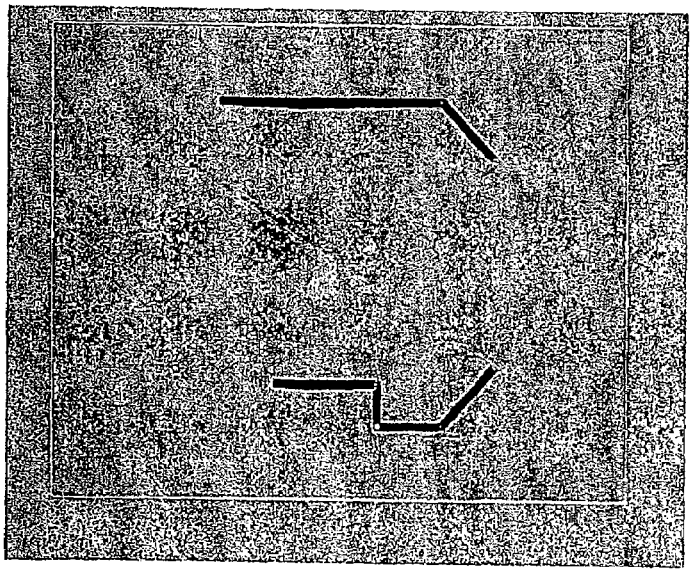
FIG. 15 shows a high view of a single tern.
Figure 16:
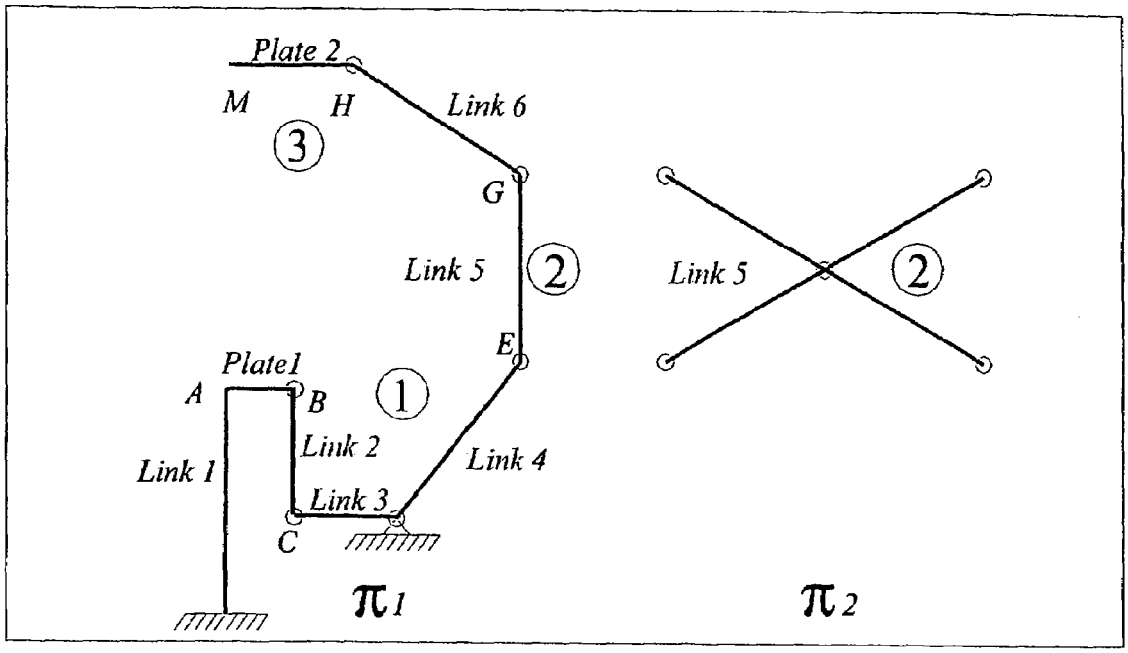
FIG. 16 shows schemes of the three kinematisms.

The kinematisms of TYPE 1 and 3 lay on the plane $\pi 1$, whereas the TYPE 2 lays on the plane $\pi 2$, as shown in FIG. 14 and FIG. 16.

Let's establish a system of inertial reference $F_0$ with axis $z_0$ orthogonal to the platforms and passing by the two centres of the same. The kinematisms appear with polar symmetry with respect to the vertical axis joining the centres of the two platforms.

Figure 17:
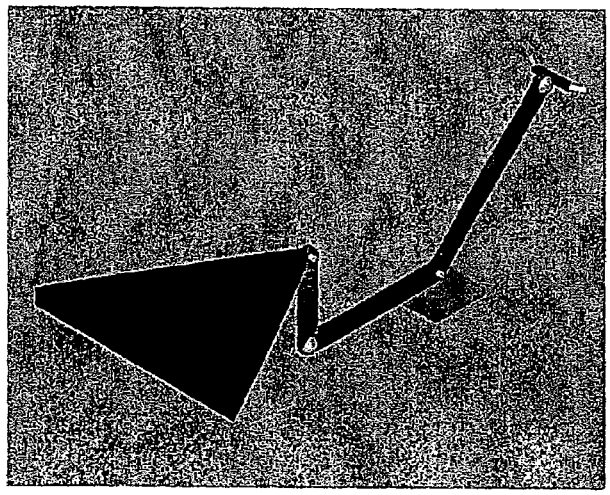
FIG. 17 shows a prospect view of the kinematism of TYPE 1.

The Kinematism of TYPE 1 of FIG. 17 constituted by Links 1, 2, 3 and 4 of FIG. 16 appears equal in three planes $\pi 1$ belonging to the beam which has the axis $z_0$ as support and rotated by 120° therebetween. Links 3 and 4 of FIG. 16 are constrained in fixed mutual position and are they hinged together in a fixed point in the space. In some cases, such as in the calculation of the degrees of freedom, they will be considered as a single body, designated Link 3-4, for convenience.

Figure 18:
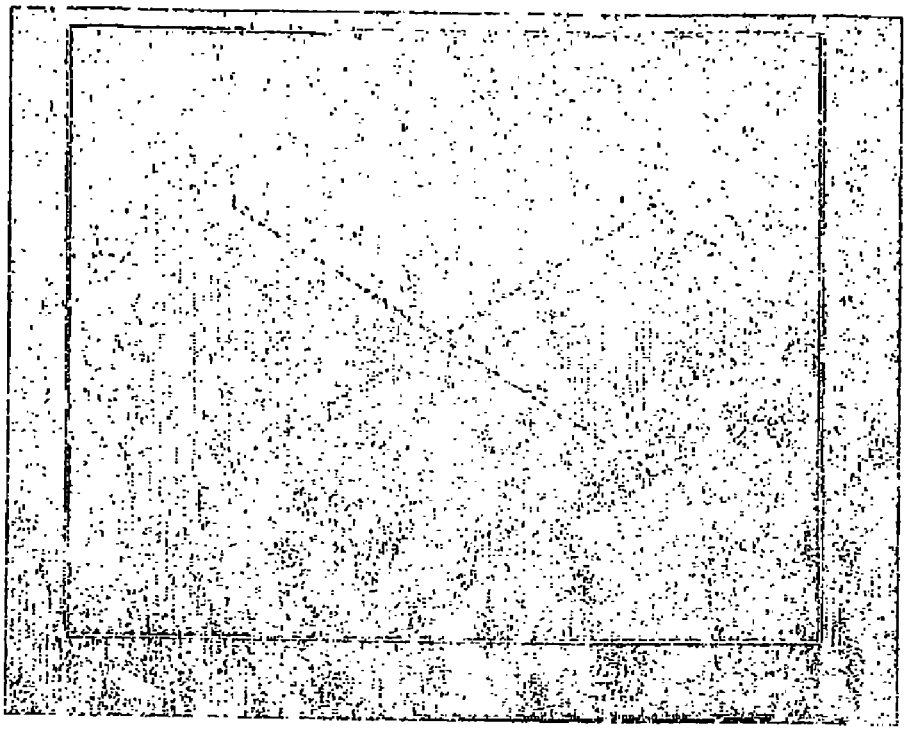
FIG. 18 shows a prospect view of the kinematism of TYPE 2.
Figure 19:
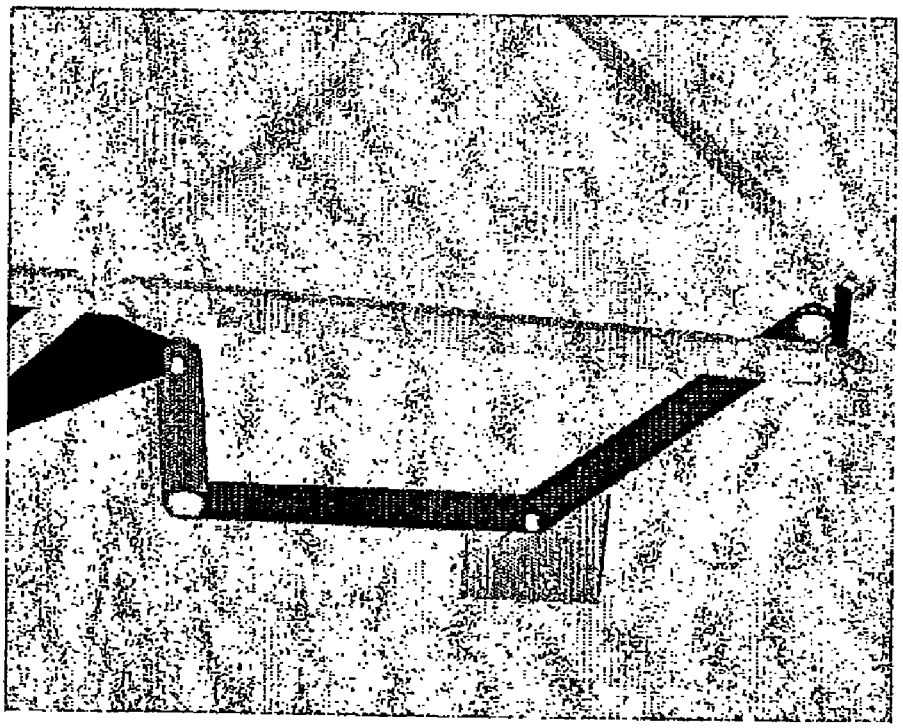
FIG. 19 shows a prospect view of the articulated joint.

The Kinematism of TYPE 2 of FIG. 18 is constituted by three pairs of Links 5 which lay in three planes $\pi_2$ rotated by 30° with respect to the respective $\pi_1$. Such planes form the side faces of a prism with triangular equilateral base the lower vertices thereof are the ends of the three Links 4 (shown in FIG. 13), constrained to the Links 5 by a suitable articulated joint. Such articulated joint, shown in FIG. 19, allows to each Link 4 to operate a pair of Links 5 belonging to two different spiders. The kinematic property of the articulated joints lies in the fact of being connected to the Links 4 by means of a ball joint and to the Links 5 by means of cylindrical joints the axes thereof, orthogonal to the respective belonging planes of the Links, intersect in the centre of the ball joint, by preventing the creation of not balanced pairs. An equal three-dimensional articulated joint is fastened to the upper ends of the Links 5 wherein the Links 6 converge.

Figure 20:
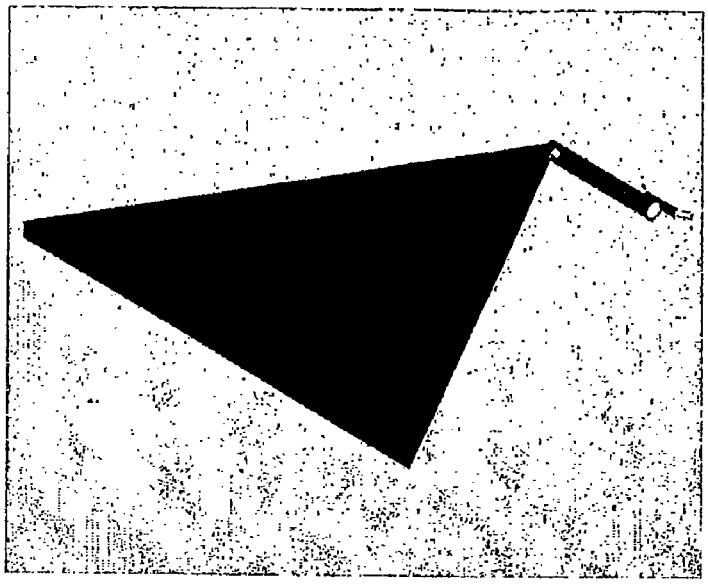
FIG. 20 shows a prospect view of the kinematism of TYPE 3.

The Kinematism of TYPE 3 of FIG. 20 is a simple mechanical leverage which transmits the motion to the upper platform: the contemporary action of the three Links 6 in the respective planes $\pi_1$ obliges the platform to translate along the axis $z_0$.

Figure 21:
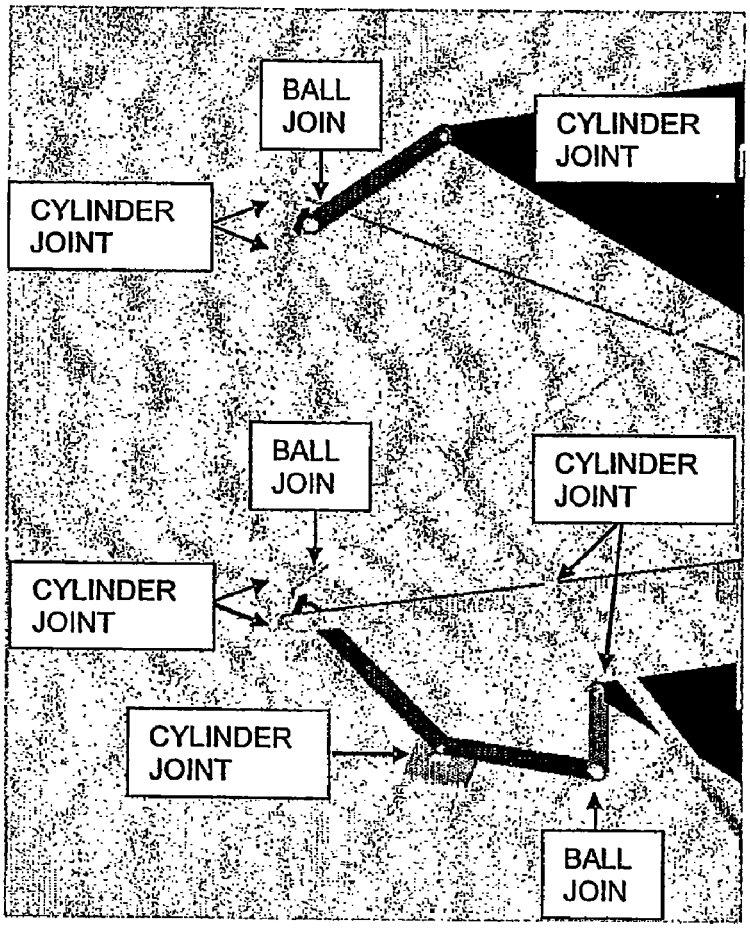
FIG. 21 shows the arrangement of the constraints.
Figure 22:
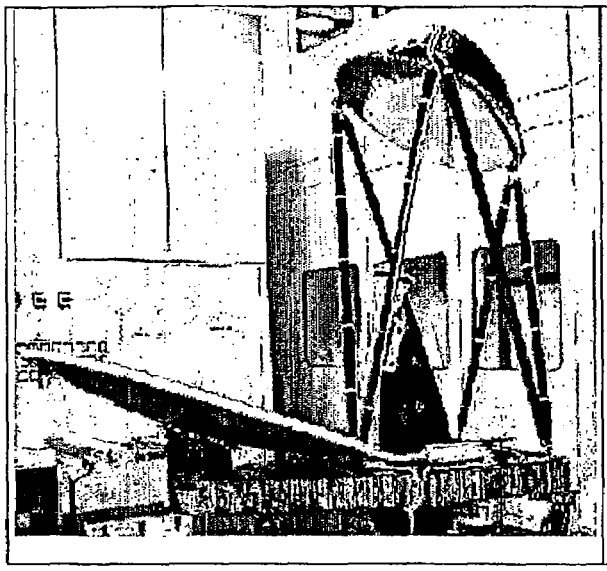
FIG. 22 shows a prospect view of a Gregorian antenna.
Figure 23:
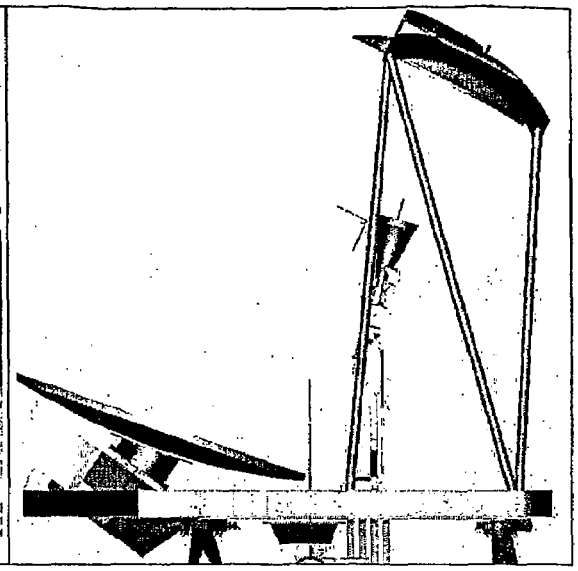
FIG. 23 shows a lateral view of a Gregorian antenna having integrated the mechanism of the invention below the main reflector, without substantially modifying the mechanical design.

The mechanism has been designed so as to show the only degree of translation freedom along the axis z, which translates into a relative motion between the platforms along the same axis. In order to have this kinematics, the arrangement of the constraints must be the one shown in FIG. 21.

The invention claimed is:

1. An actuation mechanism with linear guide implementing a three-dimensional rectilinear guide able to move an antenna reflector with high rectilinear features, providing adequate stiffness and strength during a transportation phase by means of a retention and release system (3) equipped with a controlled release device (6), comprising:

a) a kinematic system, constituted by the first, second and third TYPEs (TYPE1, TYPE2 and TYPE3) of kinematisms and actuated by an electromechanical linear actuator (1) placed along a first symmetry axis ($z_0$) of the kinematisms themselves, wherein i) the kinematism of the first TYPE, each is constituted by first, second, third and fourth links (Link 1, Link 2, Link 3 and Link 4), appear equal in first three planes ($\pi_1$) belonging to the beam having the first axis ($z_0$) as a common axis and located 120° respective to each other, the third and fourth links are constrained in fixed mutual position and hinged together in a fixed point in the space;

ii) the kinematisms of the second TYPE are constituted by three pairs of fifth links (Links 5) which lie in second three planes ($\pi_2$) rotated by 30° with respect to the respective first three planes ($\pi_1$), said second three planes forming the side faces of a prism with a equilateral triangular base having vertices thereof, the ends of the three fourth links constrained to the fifth links by means of a suitable articulated joint, to allow each of the fourth links to actuate a pair of the fifth links belonging to two different spiders;

iii) the kinematism of the third TYPE is a mechanical leverage which transmits the motion to an upper Platform (5) and a contemporary action of the three sixth links in the respective first three planes ($\pi_1$) obliging the platform to translate along the first axis (z0); and b) the retention and release system (3) comprises three identical V-like structures placed at 120 degrees with respect to each other and equipped with the controlled release device (6) wherein the controlled release is obtained by means of shape-memory alloys and connected to a supporting structure (4) by means of elastic hinges (7).

2. The actuation mechanism with linear guide according to claim 1 wherein the actuation is implemented by means of a linear actuator of hydraulic type.

3. The actuation mechanism with linear guide according to claim 1 wherein the actuation is implemented by means of a linear actuator of pneumatic type.

4. The actuation mechanism with linear guide according to claim 1 wherein the retention and release system is connected to the supporting structure by means of hinges based upon the use of spherical bearings or bushes.

5. The actuation mechanism with linear guide according to claim 1 wherein the controlled release is obtained by means of a pyrotechnical device.

6. The actuation mechanism with linear guide according to claim 1 able to support any object different from an antenna reflector to be moved after a transportation phase.

* * * * *